US012414673B2

(12) United States Patent
Kim et al.

(10) Patent No.: US 12,414,673 B2
(45) Date of Patent: Sep. 16, 2025

(54) SHOE CARE APPARATUS

(71) Applicant: SAMSUNG ELECTRONICS CO., LTD., Suwon-si (KR)

(72) Inventors: Jindoo Kim, Suwon-si (KR); Jaeryong Park, Suwon-si (KR); Ilsung Bae, Suwon-si (KR); Sejin Yun, Suwon-si (KR); Hakjae Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 714 days.

(21) Appl. No.: 17/846,295

(22) Filed: Jun. 22, 2022

(65) Prior Publication Data

US 2022/0313061 A1 Oct. 6, 2022

Related U.S. Application Data

(63) Continuation of application No. PCT/KR2020/012458, filed on Sep. 16, 2020.

(30) Foreign Application Priority Data

Dec. 30, 2019 (KR) ..... 10-2019-0177965

(51) Int. Cl.
*A47L 23/20* (2006.01)
*A47B 61/04* (2006.01)
*A47L 23/18* (2006.01)

(52) U.S. Cl.
CPC ..... *A47L 23/205* (2013.01); *A47B 61/04* (2013.01); *A47L 23/18* (2013.01)

(58) Field of Classification Search
CPC ..... A47L 23/205; A47B 61/04; A47B 23/18
(Continued)

(56) References Cited

U.S. PATENT DOCUMENTS 5,199,188 A * 4/1993 Franz ..... A47L 23/205 34/104
5,666,743 A * 9/1997 Dawson ..... A47L 23/205 34/202

(Continued)

FOREIGN PATENT DOCUMENTS

CN 201542368 U 8/2010
CN 115768329 A * 3/2023 ..... A47B 61/04

(Continued)

OTHER PUBLICATIONS

Extended European Search Report dated Dec. 8, 2023 in European Patent Application No. 20909232.9.

(Continued)

*Primary Examiner* — Stephen M Gravini
(74) *Attorney, Agent, or Firm* — STAAS & HALSEY LLP

(57) ABSTRACT

A shoe care apparatus includes a case having a first surface having a first length extending along a first direction and a second surface having a second length extending along a second direction perpendicular to the first direction, the second length being shorter than the first length. The shoe care apparatus includes a shoe support device to receive heated air from a supply port on the case and is formed to be attachable to and detachable from an inner surface of the side wall of the case, and a side duct disposed outside of the side wall of the case in the second direction and connectable to the supply port, wherein the shoe support device includes a support frame formed to protrude along the first direction from a side surface of the shoe care compartment while the support frame is mounted on the shoe care compartment.

20 Claims, 13 Drawing Sheets

(58) Field of Classification Search
USPC ..... 34/140
See application file for complete search history.

(56) References Cited

U.S. PATENT DOCUMENTS

| | | | | |
|---|---|---|---|---|
| 8,141,268 | B2 * | 3/2012 | Vezina | D06F 59/02 211/38 |
| 8,387,274 | B2 * | 3/2013 | Ashrafzadeh | D06F 58/20 68/5 R |
| 10,100,458 | B2 * | 10/2018 | Stewart | A63B 71/0036 |
| 10,961,655 | B2 * | 3/2021 | Hinkey | D06F 59/02 |
| 11,118,311 | B2 * | 9/2021 | Sealey, II | D21F 5/14 |
| 12,186,444 | B2 * | 1/2025 | Yoo | A47L 23/02 |
| 12,201,258 | B2 * | 1/2025 | Yoo | F25B 21/02 |
| 12,232,683 | B2 * | 2/2025 | Jung | D06F 58/10 |
| 12,256,881 | B2 * | 3/2025 | Lee | F26B 3/04 |
| 2009/0193676 | A1 | 8/2009 | Shengguang et al. | |
| 2011/0048474 | A1 | 3/2011 | Kim | |
| 2022/0313061 | A1 * | 10/2022 | Kim | F26B 9/003 |
| 2024/0327095 | A1 * | 10/2024 | Sawyer | A47L 23/02 |

FOREIGN PATENT DOCUMENTS

| | | | | |
|---|---|---|---|---|
| JP | 6-277124 | A | 10/1994 | |
| KR | 20-0291502 | Y1 | 10/2002 | |
| KR | 2003-0043319 | A | 6/2003 | |
| KR | 10-0529801 | B1 | 11/2005 | |
| KR | 10-2009-0132471 | A | 12/2009 | |
| KR | 10-2011-0054666 | | 5/2011 | |
| KR | 10-1100163 | B1 | 12/2011 | |
| KR | 10-1261100 | B1 | 5/2013 | |
| KR | 10-2014-0035465 | A | 3/2014 | |
| KR | 20-2016-0001421 | | 5/2016 | |
| KR | 10-2017-0006556 | | 1/2017 | |
| KR | 10-1765858 | B1 | 8/2017 | |
| KR | 10-1938421 | B1 | 1/2019 | |
| KR | 10-2019-0014780 | A | 2/2019 | |
| KR | 10-1938420 | B1 | 4/2019 | |
| KR | 20210085188 | A * | 7/2021 | |
| WO | WO-2021137389 | A1 * | 7/2021 | A47B 61/04 |

OTHER PUBLICATIONS

Office Action dated Apr. 9, 2024 for corresponding Korean application No. 10-2019-0177965.
Office Action dated Apr. 9, 2024 for Korean application No. 10-2022-0038393.
International Search Report issued in International Application No. PCT/KR2020/012458 dated Jan. 15, 2021.
International Written Opinion issued in International Application No. PCT/KR2020/012458 dated Jan. 15, 2021.
Notice of Allowance issued by the Korean Patent Office Oct. 29, 2024 for Korean Patent Application No. 10-2022-0038393.
Notice of Allowance issued by the Korean Patent Office for Korean Patent Application No. 10-2019-0177965.
Communication under Rule 71(3) EPC issued Mar. 4, 2025 for Application No. 20 909 232.9.

* cited by examiner

SHOE CARE APPARATUS

CROSS-REFERENCE TO RELATED APPLICATION(S)

This application is a continuation application, under 35 U.S.C. § 111(a), of International Patent Application No. PCT/KR2020/012458, filed on Sep. 16, 2020, which claims the benefit of Korean Patent Application No. 10-2019-0177965, filed on Dec. 30, 2019, in the Korean Intellectual Property Office, the entire disclosures of which are herein incorporated by reference as a part of this application.

BACKGROUND

Field

The present disclosure relates to a shoe care apparatus, and more particularly, to a shoe care apparatus that is easy to install in a hallway.

Description of Related Art

A clothes care apparatus is an apparatus that performs care of clothes, such as drying clothes and removing odors. There has been a demand to dry shoes or keep the shoes clean as well as clothes, but there is no shoe care apparatus for professionally caring for a large number of shoes, such as removing the smell of shoes and drying the shoes.

In addition, when a shoe cabinet located near a hallway has a short front surface and a long depth, it is difficult to install the shoe cabinet in the narrow hallway.

SUMMARY

An aspect of the present disclosure provides a shoe care apparatus including a case having a first surface having a first length extending along a first direction and a second surface having a second length extending along a second direction perpendicular to the first direction, the second length being shorter than the first length, a shoe care compartment provided inside the case, a supply port formed on a side wall of the case to supply heated air to the shoe care compartment, a shoe support device provided to receive the heated air from the supply port and formed to be attachable to and detachable from on an inner surface of the side wall of the case, and a side duct disposed outside of the side wall of the case along the second direction and connectable to the supply port so as to supply the heated air to the shoe care compartment, wherein the shoe support device is configured to allow shoes to be hanged and includes a support frame formed to protrude along the first direction from a side surface of the shoe care compartment while the support frame mounted on the shoe care compartment.

The shoe support device may be mounted on the shoe care compartment along the second direction.

The support frame may include an injection hole formed on at least one of a side surface and a lower surface of the support frame to supply the heated air to a shoe.

The support frame may be a first support frame, the shoe support device may further include a second support frame, and the first support frame and the second support frame may be formed to protrude from the side wall of the case along the first direction and be disposed to be spaced apart from each other along the second direction.

The shoe care apparatus may further include a mounting rail formed on the side wall of the case along the first direction so that the shoe support device is enabled to be fixed to the shoe care compartment.

The mounting rail may have one end closed to prevent the shoe support device from being separated, and another end open to allow the shoe support device to be inserted.

The mounting rail may be inclined along an upward direction from the one end toward the other end so that the shoe support device remains inserted into the mounting rail.

The shoe care apparatus may further include a duct plate connectable to the side duct to supply the heated air to the shoe care compartment.

The shoe care apparatus may further include a hanging frame connectable to the duct plate to receive the heated air and formed to extend to an upper side of the shoe care compartment to allow a shoe to be hanged, wherein the hanging frame may include an injection hole formed on an outside of the hanging frame to supply the heated air to the shoe.

The duct plate may include an injection port formed on a lower surface of the duct plate to allow the heated air to be supplied downward from the duct plate.

The shoe care apparatus may further include a machine compartment provided at a lower portion of the case, wherein the machine compartment may be provided with a condenser, an evaporator, and a fan provided to blow the heated air passing through the condenser and the evaporator, and the condenser, the evaporator, and the fan may be arranged along the first direction.

The support frame may be formed to be inclined upwards to maintain the shoe on the support frame.

The shoe support device may include a handle provided between the first support frame and the second support frame.

The shoe care apparatus may further include a controller provided to control a temperature in the shoe care compartment to thereby reduce damage to the shoes.

Another aspect of the present disclosure provides a shoe care apparatus including a case having a first surface having a first length extending along a first direction and a second surface having a second length extending along a second direction perpendicular to the first direction, the second length being shorter than the first length, a shoe care compartment provided inside the case, a machine compartment provided at a lower portion of the case and including a condenser, an evaporator, and a fan, a supply port formed on a side wall of the case to supply heated air to the shoe care compartment, a shoe support device provided to receive the heated air from the supply port and formed to be attachable to and detachable from on the shoe care compartment, and a side duct disposed outside of the side wall of the case along the first direction and connectable to the supply port so as to supply the heated air to the shoe care compartment, wherein the condenser, the evaporator, and the fan are arranged along the first direction.

The shoe support device may be configured to allow shoes to be hanged and may include a support frame formed to protrude along the first direction from the side wall of the case while the support frame is mounted on the shoe care compartment.

The shoe support device may be formed to be mounted on the shoe care compartment along the second direction.

Another aspect of the present disclosure provides a shoe care apparatus including a case having a first surface having a first length extending along a first direction and a second surface having a second length extending along a second direction perpendicular to the first direction, the second length being shorter than the first length, a shoe care compartment provided inside the case, a supply port formed on an upper wall of the case to supply heated air to the shoe care compartment, a shoe support device provided to receive the heated air from the supply port and formed to be attachable to and detachable from on an inner surface of the upper wall of the case, and a side duct disposed outside of the upper wall of the case along the first direction and connectable to the supply port so as to supply the heated air to the shoe care compartment.

The shoe support device may be configured to allow shoes to be hanged and may include at least one support frame formed to protrude along the first direction while the at least one support frame is mounted on the shoe care compartment.

The at least one support frame is a first support frame, and the shoe support device include a second support frame, a third support frame, and a fourth support frame, the first support frame and the second support frame may be formed to protrude along the first direction and be disposed to be spaced apart from each other along the second direction, and the third support frame and the fourth support frame may be formed to protrude along a direction opposite to the first direction and be disposed to be spaced apart from each other along the second direction.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
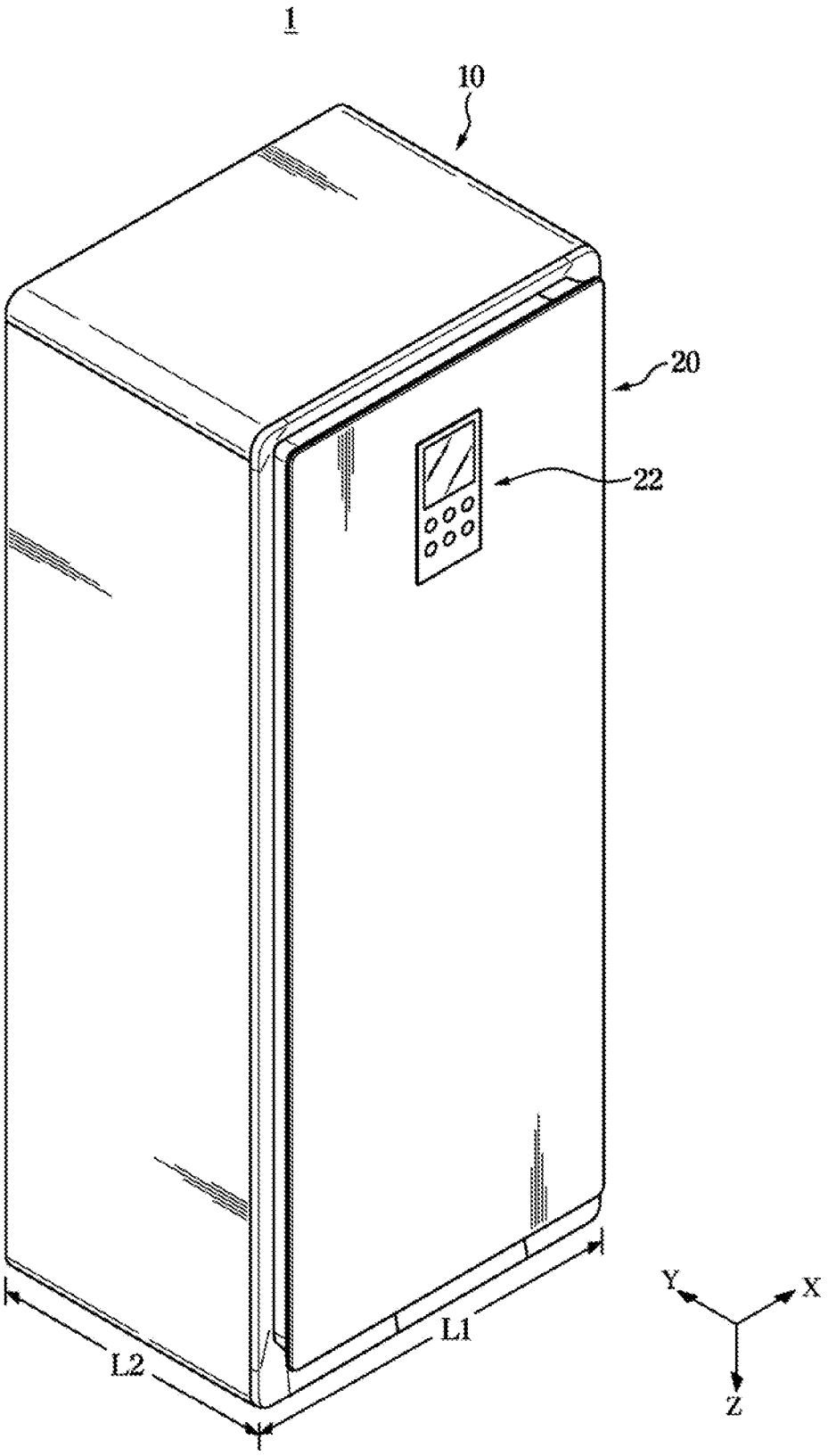
FIG. 1 is a view illustrating a shoe care apparatus according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

In this specification, the terms "the front," "the rear," "the left side," and "the right side" used in the following description are defined with reference to the drawings, and the shape and position of each component are not limited by these terms.

The present disclosure is directed to providing a shoe care apparatus that is easy to install in a hallway in consideration of lengths of front and side surfaces.

The present disclosure is directed to providing a shoe care apparatus that is easy to care for regardless of a length of a neck of a shoe.

The present disclosure is directed to providing a shoe care apparatus capable of taking care of a large number of shoes at once.

According to the present disclosure, because a front surface extending in a first direction is formed longer than a side surface extending in a second direction, a shoe care apparatus that is easy to install in a hallway can be provided.

According to the present disclosure, shoes can be taken care of regardless of a length of a neck of the shoes by a support frame and a mounting frame.

According to the present disclosure, a large number of shoes can be taken care of at once by a plate and a shoe support device.

Figure 2:
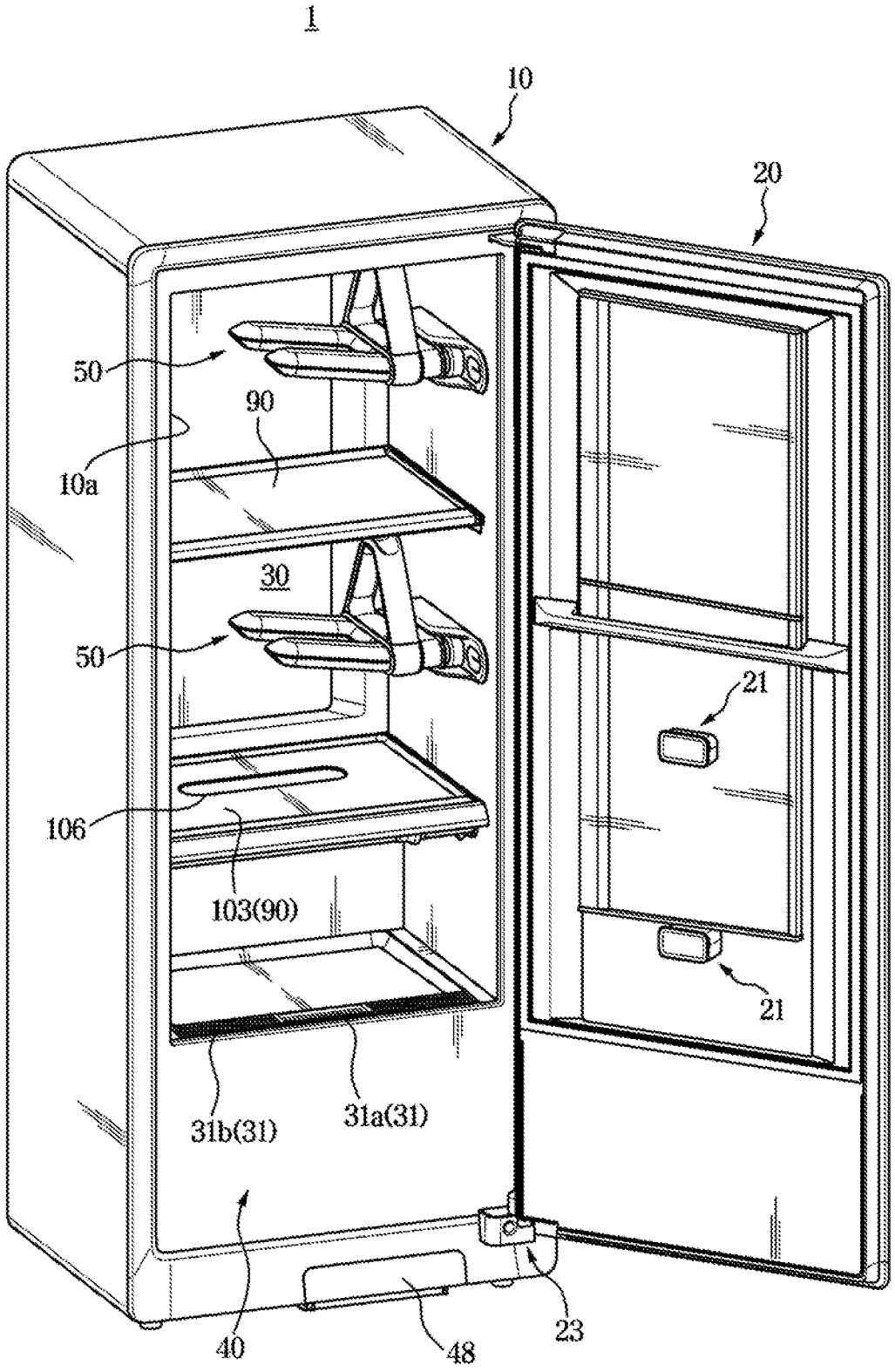
FIG. 2 is a perspective view illustrating that a door of the shoe care apparatus illustrated in FIG. 1 is opened according to an embodiment of the present disclosure.

Specifically, as illustrated in FIGS. 1 and 2, when a door of a shoe care apparatus is opened, a direction of directing to an inner surface is defined as the front, and based on this, the rear, left and right sides, and upper and lower sides are defined.

Hereinafter, embodiments of the present disclosure will be described in detail with reference to the accompanying drawings.

Figure 3:
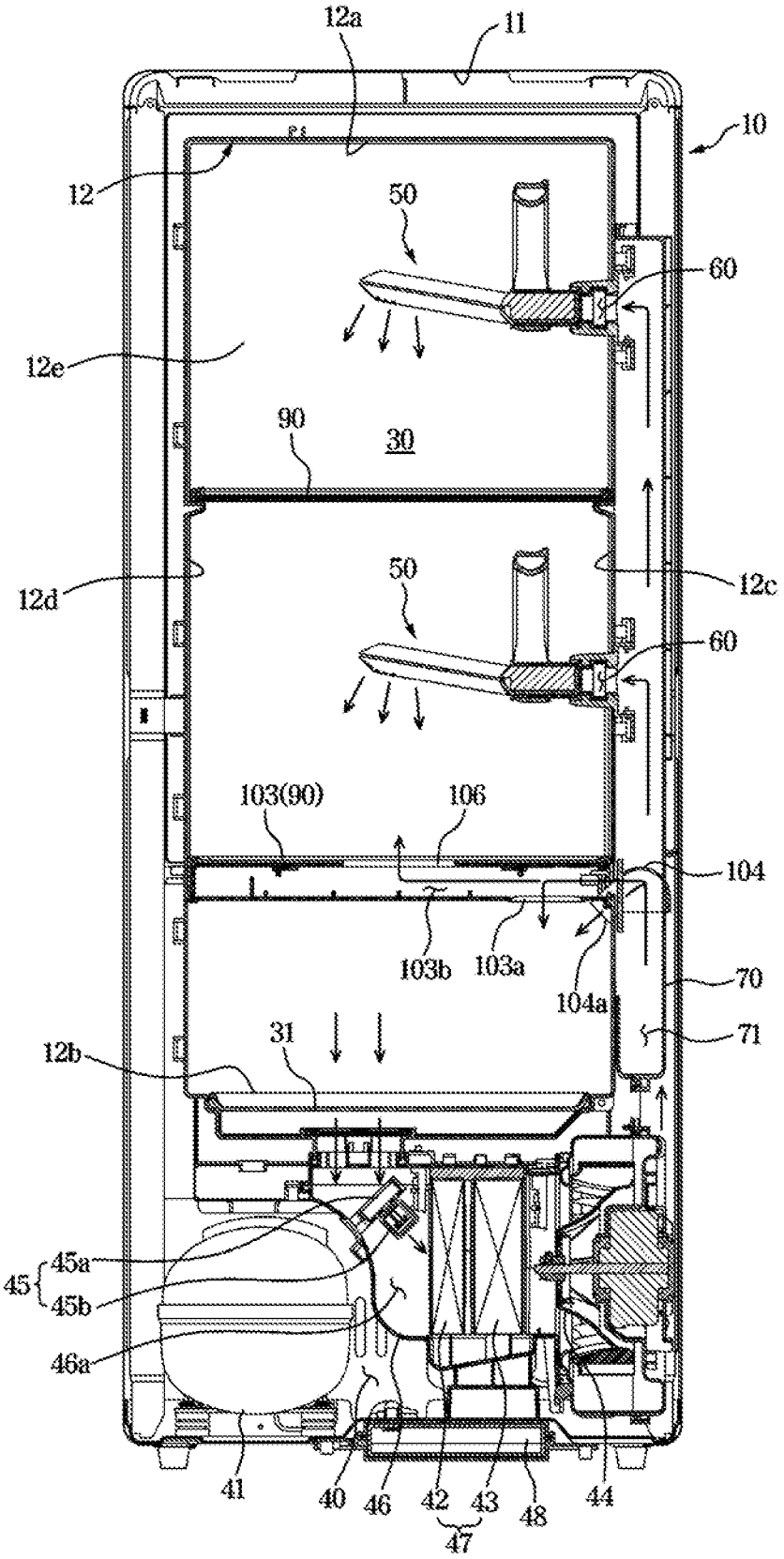
FIG. 3 is a front cross-sectional view of the shoe care apparatus illustrated in FIG. 1 according to an embodiment of the present disclosure.

FIG. 1 is a view illustrating a shoe care apparatus according to an embodiment of the present disclosure. FIG. 2 is a perspective view illustrating that a door of the shoe care apparatus illustrated in FIG. 1 is opened. FIG. 3 is a front cross-sectional view of the shoe care apparatus illustrated in FIG. 1.

As illustrated in FIGS. 1 to 3, a shoe care apparatus 1 may include a main body 10 forming an exterior and a door 20 rotatably coupled to the main body 10.

The main body 10 may be provided in a rectangular parallelepiped shape with an open front side. An opening 10*a* may be formed in the open front side of the main body 10. The door 20 may be rotatably coupled to the main body 10 to open and close the open front side of the main body 10. The door 20 may be coupled to the main body 10 through a hinge 23 or the like.

The door 20 may include a hanging member 21 provided on a surface facing the inside of a shoe care compartment 30. One or more of the hanging members 21 may be provided. The hanging member 21 may easily store a shoe support device 50 by hanging a handle 55 of the shoe support device 50, which will be described later. However, the hanging member is not limited thereto and may be used for hanging other components.

The door 20 may further include an input device 22 provided on a front surface of the shoe care apparatus 1. A user may set a care course suitable for a shoe to the input device 22 depending on the type of shoes to be cared for. Through this, by controlling a temperature and humidity in the shoe care compartment 30 by a controller 200, which will be described later, damage to the shoe may be reduced.

The main body 10 may include an outer case 11 and an inner case 12 disposed inside the outer case 11. The main body 10 may include the shoe support device 50 provided inside the shoe care compartment 30 to support the shoe. The inner case 12 may be referred to as a case.

The main body 1 may be provided such that a length of a front surface extending in a first direction X and a length of a side surface extending in a second direction Y are different. That is, a length L1 of the front surface may be longer than a length L2 of the side surface. Due to this, even in the case of a narrow hallway, the shoe care apparatus 1 may be easily installed. The length of the front surface may be the first length L1, and the length of the side surface may be the second length L2.

The main body 10 may include a machine compartment 40 provided with a heat exchanger 47 to dehumidify or heat air inside the shoe care compartment 30 and the like.

The shoe care compartment 30 may form a space in which the shoes are accommodated. The shoe care compartment 30 may include an upper surface 12*a*, a lower surface 12*b*, a left surface 12*c*, a right surface 12*d*, and a rear surface 12*e*, which are provided in the inner case 12. The shoe care compartment 30 may be provided inside the inner case 12.

The inner case 12 may include a frame (not shown) provided to support the upper surface 12*a*, the lower surface 12*b*, the left surface 12*c*, the right surface 12*d*, and the rear surface 12*e*.

The shoe support device 50 may be installed on the left surface 12*c* or the right surface 12*d* of the shoe care compartment 30. That is, the shoe support device 50 may be installed such that a side of the shoe is visible when viewed from the front of the shoe care apparatus 1. Due to this, the length of the side surface may be formed shorter.

The shoe support device 50 may be detachably installed to the shoe care compartment 30. One or more of the shoe support devices 50 may be provided. The shoe support device 50 may be formed in a shape in which the shoe may be fitted. A detailed description thereof will be given later.

A drain container 48 provided detachably from the main body 10 may be installed at a lower portion of the main body 10. The drain container 48 may be disposed below the shoe care compartment 30.

The drain container 48 may be provided to facilitate the treatment of condensed water by the heat exchanger 47.

The drain container 48 may be provided at a lower portion of the machine compartment 40. The machine compartment 40 may be provided at a lower side of the main body 10. The machine compartment 40 may be provided below the shoe care compartment 30.

The heat exchanger 47 may be provided to dehumidify and heat air inside the shoe care compartment 30 as necessary.

The heat exchanger 47 may be installed to supply heated air into the shoe care compartment 30. The heat exchanger 47 may include an evaporator 42, a condenser 43, and a compressor 41 through which a refrigerant circulates, and may be provided to dehumidify and heat air.

As the refrigerant evaporates in the evaporator 42 of the heat exchanger 47 to absorb latent heat of the surrounding air, moisture in the air may be condensed and removed.

When the refrigerant is condensed in the condenser 43 via the compressor 41, the surrounding air may be heated by releasing the latent heat toward the surrounding air.

The evaporator 42 and the condenser 43 perform a heat exchange function, so that the air introduced into the machine compartment 40 by a blowing fan 44 may sequentially pass through the evaporator 42 and the condenser 43 to be dehumidified and heated.

The blowing fan 44 may be provided as a centrifugal fan that sucks air in an axial direction and discharges the air toward a side duct. However, the present disclosure is not limited thereto.

The heat exchanger 47 installed in the machine compartment 40 may include a connection duct 46 to connect the evaporator 42, the condenser 43, and the blowing fan 44, and the connection duct 46 may be connected to the shoe care compartment 30 to form a connection flow path 46*a* circulating between the shoe care compartment 30 and the connection duct 46.

The shoe care apparatus may further include a water supply container (not shown), a steam generator (not shown), and a steam injector (not shown). The water supply container may be disposed below the shoe care compartment 30. Water in the water supply container may be supplied to the steam generator and used to generate steam. The water supply container may be detachably installed on the main body to facilitate water replenishment.

The machine compartment 40 may be provided with the steam generator to generate steam by receiving water from the water supply container.

The steam generator may receive water by being connected to a water supply container to generate steam, and may include a steam supply pipe (not shown) to guide the generated steam to the steam injector (not shown).

The evaporator 42, the condenser 43, and the blowing fan 44 may be arranged in the first direction X so that air flows in the first direction X. The steam generator may also be arranged along the first direction X. Because the length of the side surface may be reduced as the evaporator 42, the condenser 43, the blowing fan 44 and the steam generator are all arranged in the first direction X, the shoe care apparatus may be easily installed in the hallway. The shoe care apparatus 1 may further include a deodorizer 45. The deodorizer 45 may be disposed in the machine compartment 40. The deodorizer 45 may be disposed in the connection duct 46 to remove odors in the air passed through the shoe care compartment 30. Although the drawing illustrates that the deodorizer 45 is provided on the right side of the blowing fan 44, the present disclosure is not limited thereto, and the deodorizer 45 may also be provided on the left side of the blowing fan 44.

The deodorizer 45 may include a deodorizing filter 45*a* and a sterilizing lamp 45*b*. The deodorizing filter 45*a* may include a ceramic filter. The sterilizing lamp 45*b* may include an ultraviolet lamp. However, the present disclosure is not limited thereto, the deodorizing filter 45*a* may include various filters as long as odors in air may be removed, and the sterilizing lamp 45*b* may also include various devices as long as bacteria may be sterilized.

The shoe care compartment 30 may include at least one plate 90. The plate 90 may be disposed in the shoe care compartment 30 to place shoes thereon. A supply port 60 and the shoe support device 50 may be provided adjacent to the plate 90.

The plate 90 may include a duct plate 103. As illustrated in FIG. 3, the duct plate 103 may include an inner flow path 103*b*. The heated air passing through the inner flow path 103*b* may be injected toward the shoes from an injection port 103*a* of the duct plate 103 and an injection port 104*a* of a circular duct 104. The heated air may also pass through the inner flow path 103*b* and be introduced into the shoe care compartment 30 through an inlet 57.

The shoe care compartment 30 may further include the supply port 60 and an outlet 31.

The supply port 60 may be formed on a side wall of the inner case 12. That is, the supply port 60 may be formed on the left surface 12*c* of the shoe care compartment 30. However, the present disclosure is not limited thereto, and the supply port may be formed on the right surface 12*d*. One or more of the supply ports 60 may be formed to be supply heated air into the shoe care compartment 30 to dry the shoes. The shape of the supply port 60 may be circular. However, the present disclosure is not limited thereto, and as long as the shoes may be dried by supplying the heated air into the shoe care compartment 30, the supply port may include various shapes such as a rectangle and a polygon.

The outlet 31 may be disposed in front of the lower surface 12*b* of the shoe care compartment 30. However, the present disclosure is not limited thereto, and the outlet may be disposed at the rear and a side of the lower surface 12*b* of the shoe care compartment 30. Air that has dried the shoes in the shoe care compartment 30 may flow to the connection duct 46, which will be described later, through the outlet 31.

The outlet 31 may include a discharge hole 31*a* and a discharge grill 31*b*. However, the present disclosure is not limited thereto, and as long as the heated air may be smoothly supplied to the connection duct 46, the above components may be omitted.

The connection duct 46 may be connected to a side duct 70 and the outlet 31 of the shoe care compartment 30. One end of the connection duct 46 may be connected to the side duct 70, and the other end thereof may be connected to the outlet 31. The air introduced through the outlet 31 may be dehumidified and reintroduced into the shoe care compartment 30 through the side duct 70 and the supply port 60.

The side duct 70 may be provided on the outside of the side wall of the inner case 12 in the second direction Y so that the front surface of the shoe care apparatus 1 is long and the side surface thereof is short. One end of the side duct 70 may be connected to the at least one supply port 60, and the other end thereof may be connected to the connection duct 46. The side duct 70 may form a side flow path 71 provided to move the heated air to the supply port 60.

The shoe care compartment 30 may further include the shoe support device 50 and a mounting rail 80.

The shoe support device 50 may be detachably mounted on an inner surface of the side wall of the inner case 12. That is, the shoe support device 50 and the mounting rail 80 may be disposed on the left surface 12*c* of the shoe care compartment 30. However, the present disclosure is not limited thereto, and as long as the heated air may be supplied, the shoe support device and the mounting rail may be disposed on the right surface 12*d* of the shoe care compartment 30. The shoe support device 50 may be detachably installed on the mounting rail 80.

The shoe support device 50 may be installed on the mounting rail 80 along the second direction Y. That is, a side of the shoe hung on the shoe support device 50 may be disposed to face a front-rear direction of the shoe care apparatus 1. Due to this, the side of the shoe may be disposed to face the front-rear direction of the shoe care apparatus 1. Therefore, the length of the left and right surfaces of the shoe care apparatus 1 may be reduced.

Because the shoe support device 50 is detachable from the shoe care compartment 30, when a shoe hanging device 100 for long boots, which will be described later, is installed in the shoe care compartment 30 or shoes are placed on the plate 90, The shoe support device 50 may be separated to utilize a space.

Figure 4:
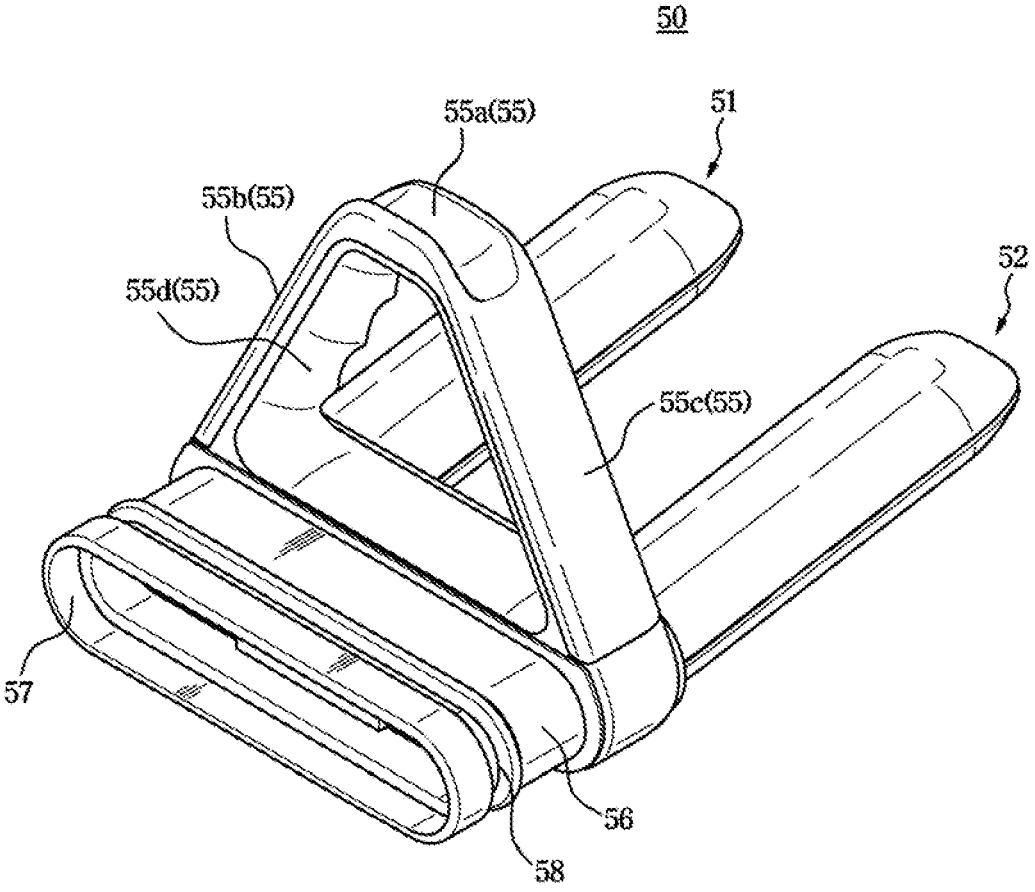
FIG. 4 is a perspective view illustrating a shoe support device of the shoe care apparatus illustrated in FIG. 1 according to an embodiment of the present disclosure.
Figure 5:
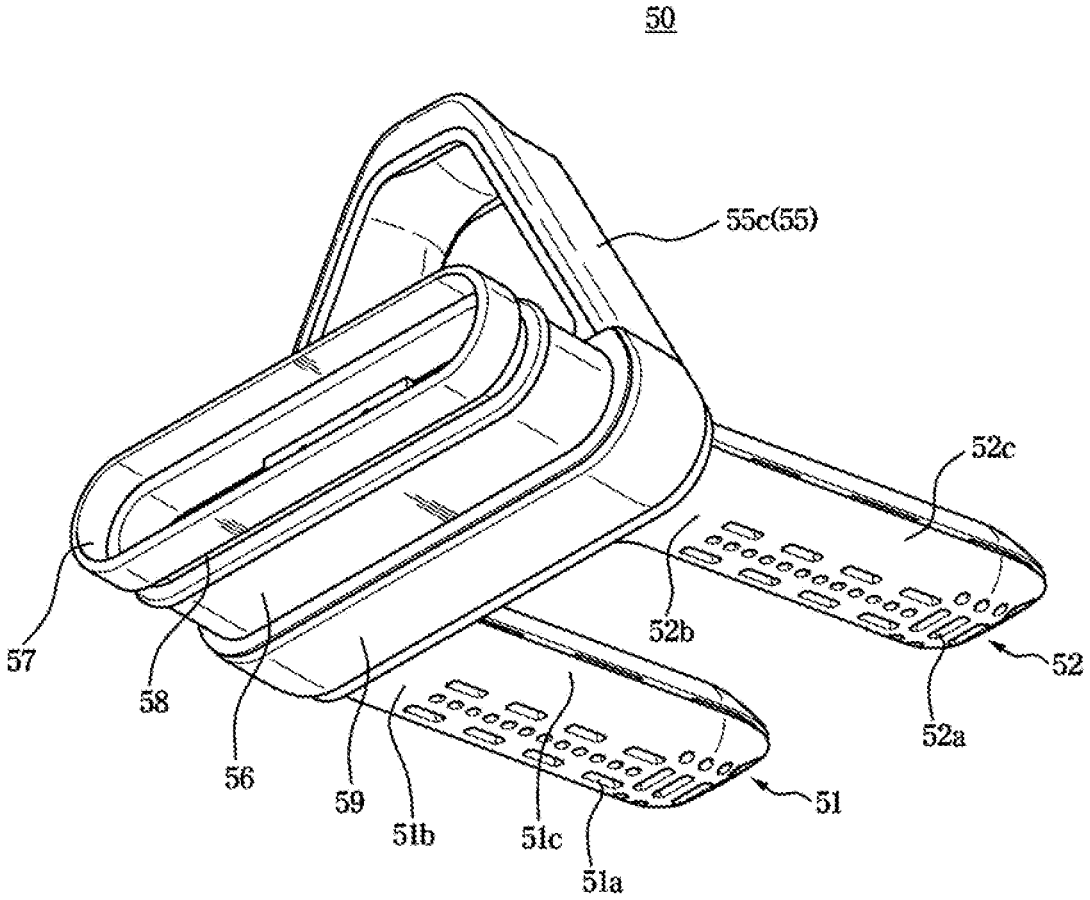
FIG. 5 is a bottom perspective view of the shoe support device of the shoe care apparatus illustrated in FIG. 4 according to an embodiment of the present disclosure.

FIG. 4 is a perspective view illustrating a shoe support device of the shoe care apparatus illustrated in FIG. 1. FIG. 5 is a bottom perspective view of the shoe support device of the shoe care apparatus illustrated in FIG. 4.

Referring to FIGS. 4 and 5, the shoe support device 50 may include support frames 51 and 52, a handle 55, a support body 56, and the inlet 57.

The support frames 51 and 52 may include the first support frame 51 and the second support frame 52. The first support frame 51 and the second support frame 52 may protrude along the first direction X from a side surface of the shoe care compartment 30 and may be disposed to be spaced apart from each other along the second direction Y. The drawings illustrate that two support frames are provided, but the present disclosure is not limited thereto, and one or three or more support frames may be provided as long as the shoes may be hung. Because the first support frame 51 and the second support frame 52 are provided to be spaced apart from each other in the second direction, the shoes may be supported thereon and taken care of, respectively.

Because the support frames 51 and 52 protrude from the side surface of the shoe care compartment 30 in the first direction X, the side surface of the shoe may be disposed to face the front-rear direction of the shoe care apparatus 1. Due to this, the length of the left and right surfaces of the shoe care apparatus 1 may be reduced.

The support frames 51 and 52 may have a predetermined angle such that the hung shoe is not taken off That is, the support frames 51 and 52 may be formed to be inclined upward with respect to the lower surface 12*b* of the shoe care compartment 30. Therefore, the shoe may not fall off even when the shoe support device 50 is carried and moved, or mounted on the shoe care compartment 30. However, the present disclosure is not limited thereto, and the shoe support device may not have the predetermined angle as long as the shoe is not taken off.

The handle 55 may allow the user to easily move the shoe support device 50 when the user moves only the shoe support device 50 or when the shoe support device 50 supports the shoe and is installed on the mounting rail 80. The portion 55 may include a connection part 55*a* and a support member. The connection portion 55*a* of the handle 55 may be connected to support members 55*b* and 55*c* at opposite ends thereof. That is, the support member may include the first support member 55*b* and the second support member 55*c*.

The connection portion 55*a*, the first support member 55*b*, and the second support member 55*c* may be provided to be formed in a triangular shape between the first support frame 51 and the second support frame 52. The handle 55 may be disposed in the second direction Y between the first support frame 51 and the second support frame 52. Due to the position and shape as described above, the handle may be provided adjacent to the center of gravity of the shoes, thereby reducing strain on a wrist when the user carries and moves the shoes. However, the handle is not limited to such a shape and location, and may be deformed to have a shape that allows the shoes to be easily moved or carried. For example, the auxiliary handle 55 connected to the connection portion 55*a* and the support member may extend in various directions, such as the first direction X and the second direction Y.

A grip groove 55*d* for allowing the user to easily use the handle 55 may be formed on the support members 55*b* and 55*c*. The grip groove 55*d* may be formed similarly to a finger shape of the user.

The support body 56 may be provided such that the handle 55, the inlet 57, and the support frames 51 and 52 may be connected thereto. The support body 56 may extend in the first direction X between the support frames 51 and 52 and the inlet 57.

The inlet 57 may be connected to the supply port 60 so that the heated air supplied through the machine compartment 40 and the side duct 70 may be supplied to the shoe support device 50. The inlet 57 is illustrated in a circular shape, but is not limited thereto and may have various shapes.

The support frames 51 and 52 of the shoe support device 50 may include injection holes 51*a* and 52*a*, respectively. The injection holes may be formed on lower surfaces 51*b* and 52*b* or side surfaces 51*c* and 52*c* of the support frames. However, the injection holes are not limited thereto and may also be formed to supply the heated air to upper surfaces. The injection holes 51*a* and 52*a* may have any shape, such as a circle, an oval, and a rectangle, as long as the heated air may be easily supplied to the shoes. The heated air is supplied from the injection holes 51*a* and 52*a* to the shoe care compartment 30 to care for the shoes in the shoe care compartment 30.

The shoe support device 50 may further include a fastening groove 58. The fastening groove 58 may prevent the shoe support device 50 from being separated from the mounting rail 80 by coupling the mounting rail 80, which will be described later, with a fixing member 84.

The shoe support device may further include a coupling member 59. The coupling member 59 may be connected to the handle 55 to reinforce the support body 56. That is, the coupling member 59 may be respectively connected to the first support member 55*b* and the second support member 55*c*.

Figure 6:
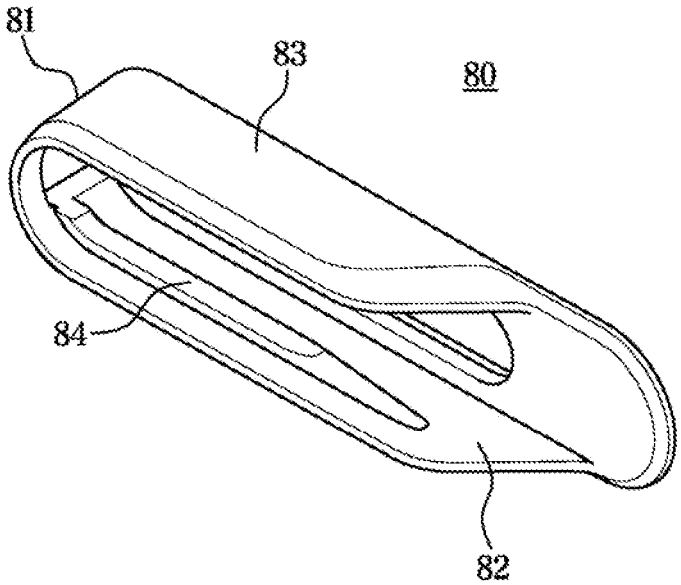
FIG. 6 is a view illustrating a mounting rail of the shoe care apparatus illustrated in FIG. 1 according to an embodiment of the present disclosure.
Figure 7:
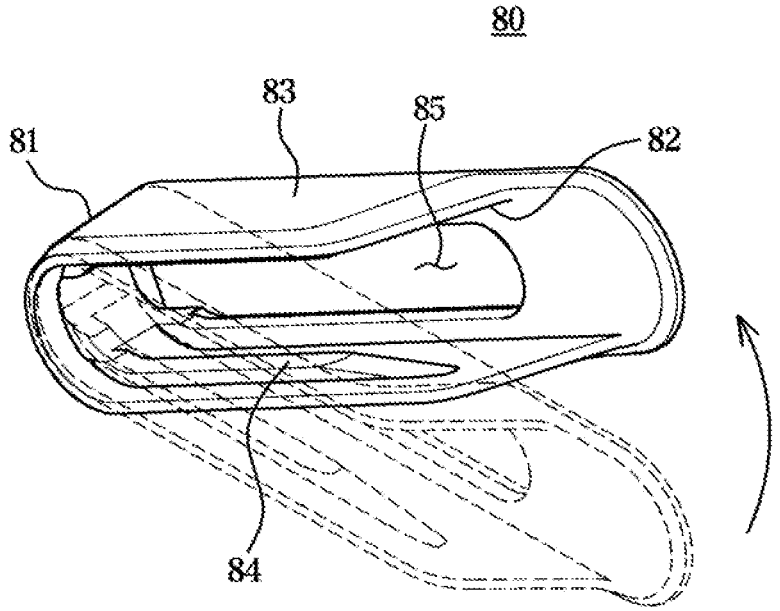
FIG. 7 is a cross-sectional view of the mounting rail of the shoe care apparatus illustrated in FIG. 6 according to an embodiment of the present disclosure.

FIG. 6 is a view illustrating a mounting rail of the shoe care apparatus illustrated in FIG. 1. FIG. 7 is a cross-sectional view of the mounting rail of the shoe care apparatus illustrated in FIG. 6.

Referring to FIGS. 6 and 7, the mounting rail 80 may include one end 81 having a closed shape such that the shoe support device 50 is not separated, the other end 82 having an open shape such that the shoe support device 50 is inserted, a connection member 83, and the fixing member 84.

When the shoe support device 50 is installed, the one end 81 of the mounting rail 80 may be formed in a closed form in order to determine an insertion position of the shoe support device 50. On the other hand, the other end 82 may be formed in an open form for the shoe support device 50 to be inserted. The connection member 83 may form an exterior of the mounting rail 80 by connecting the one end 81 and the other end 82. The fixing member 84 may be coupled to the fastening groove 58 of the shoe support device 50 described above to fix the shoe support device 50 not to be separated. Because the shoe support device 50 is detachably coupled to the mounting rail 80, the user may adjust the number of the shoe support devices 50 to be used as needed.

The mounting rail 80 may have a shape inclined upward from the closed end 81 toward the open other end 82. Due to this, the shoe support device 50 may not be separated from the shoe care compartment 30. In addition, the shoe support device 50 may be easily mounted when inserted into the mounting rail 80.

The mounting rail 80 may further include an inlet hole 85. The inlet hole 85 may be provided to be connected to the supply port 60 so that the heated air may be introduced into the shoe support device 50. That is, the inlet hole 85 may be connected to the inlet 57 of the shoe support device 50. Accordingly, the heated air may pass through the side duct 70 from the machine compartment 40 and then may be injected from the supply port 60, the inlet hole 85, and the injection hole of the shoe support device 50.

Figure 8:
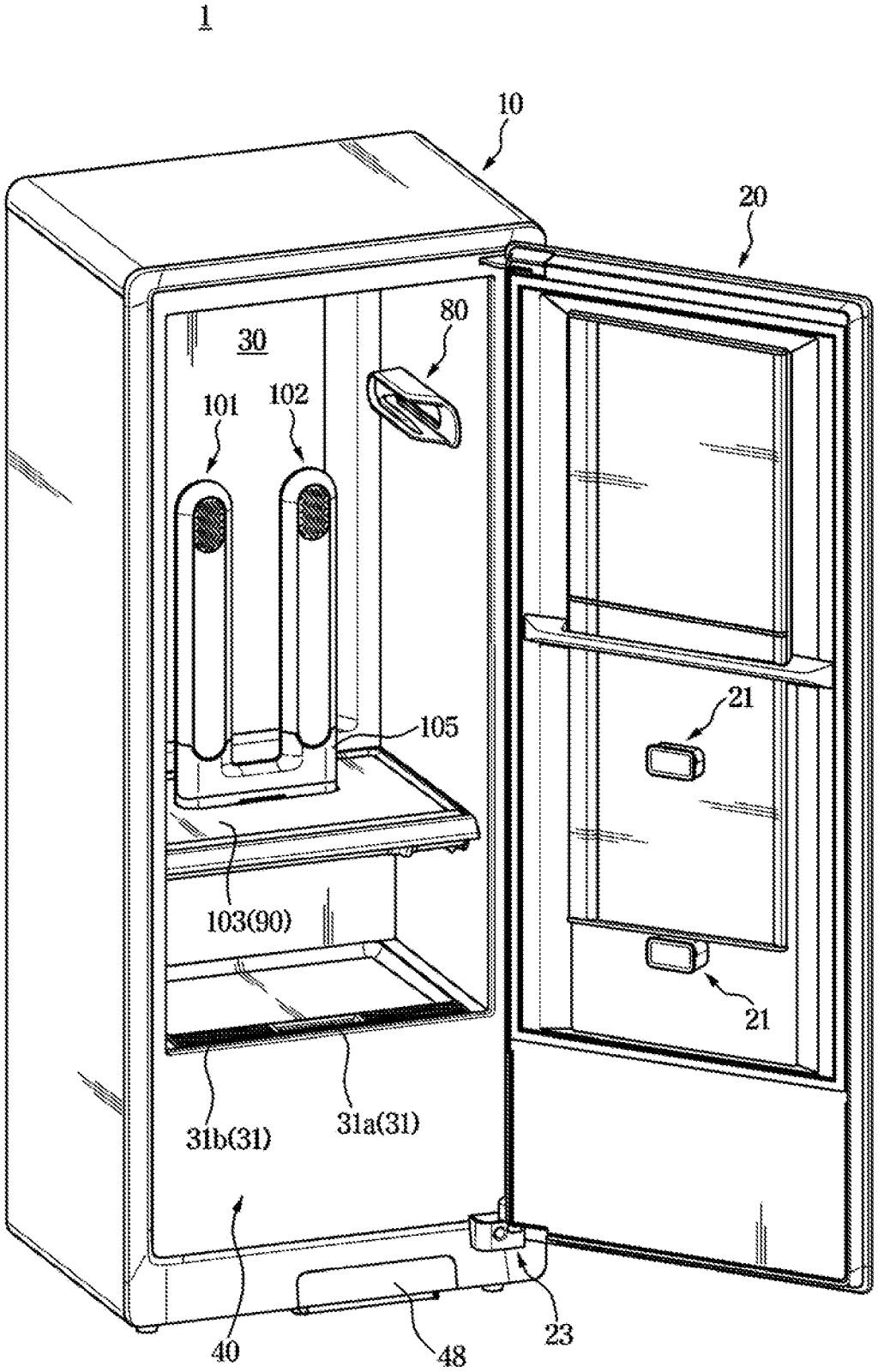
FIG. 8 is a view illustrating a shoe care apparatus according to another embodiment of the present disclosure.
Figure 9:
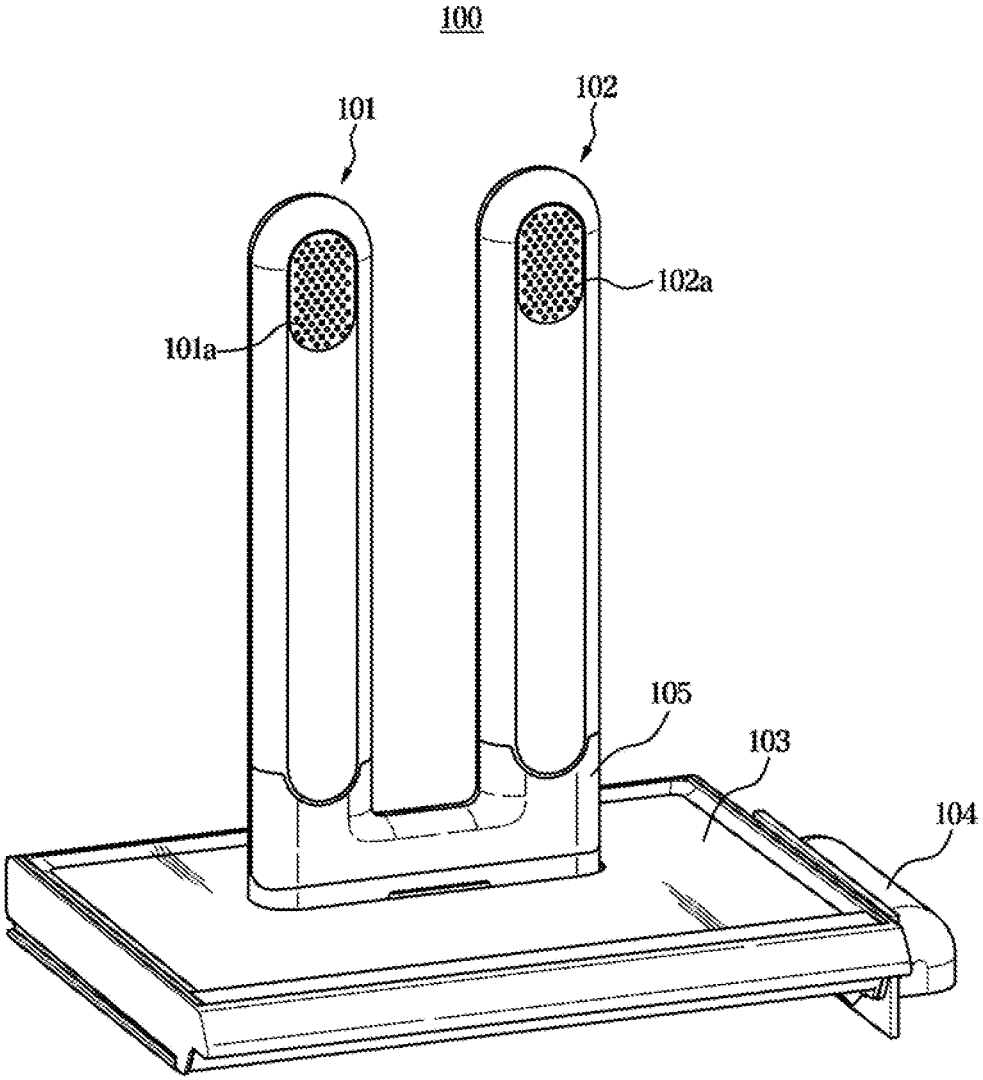
FIG. 9 is a view illustrating a shoe hanging device of the shoe care apparatus illustrated in FIG. 8 according to an embodiment of the present disclosure.
Figure 10:
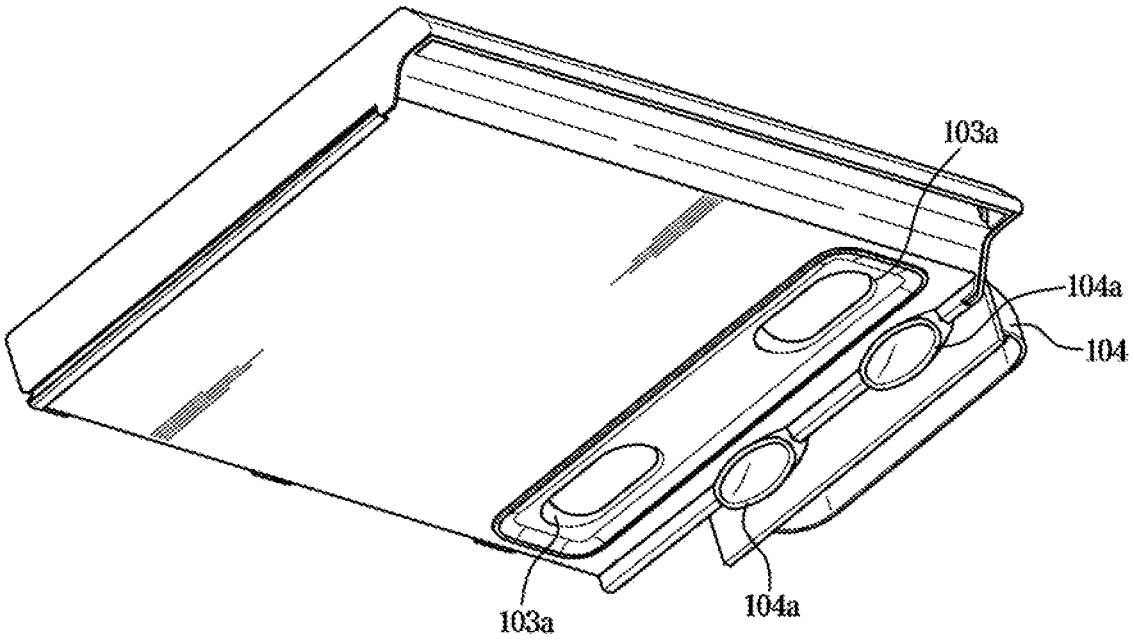
FIG. 10 is a view illustrating a duct plate of the shoe care apparatus illustrated in FIG. 8 according to an embodiment of the present disclosure.

FIG. 8 is a view illustrating a shoe care apparatus according to another embodiment of the present disclosure. FIG. 9 is a view illustrating a shoe hanging device of the shoe care apparatus illustrated in FIG. 8. FIG. 10 is a view illustrating the duct plate 103 of the shoe care apparatus illustrated in FIG. 8.

Referring to FIGS. 8 to 10, the shoe care apparatus may further include the shoe hanging device 100.

The shoe hanging device 100 may include hanging frames 101 and 102, the duct plate 103, the circular duct 104, and an extension member 105.

The hanging frames 101 and 102 may be provided to dry boots with a long neck, for example, long boots in the shoe care compartment 30. The hanging frames 101 and 102 may extend long to an upper side of the shoe care compartment 30.

The hanging frames 101 and 102 may include the first hanging frame 101 and the second hanging frame 102. Therefore, a pair of shoes may be taken care of. However, the present disclosure is not limited thereto, and one or three or more hanging frames may be provided.

The hanging frames 101 and 102 may include injection holes 101*a* and 102*a*, respectively. The heated air supplied from the side duct 70 to the duct plate 103 may be supplied to the hanging frames 101 and 102 through the connection member 83. The heated air supplied to the hanging frames may be injected through each of the injection holes 101*a* and 102*a*. A shoe with a long neck, such as a long boot, may be hung such that a sole thereof faces the upper side of the shoe care compartment 30. Due to this, the heated air may be supplied to the sole of the shoe to take care of the shoe.

The circular duct 104 may be disposed between the duct plate 103 and the side duct 70. That is, the heated air may be supplied to the duct plate 103 after passing through the circular duct 104 from the side duct 70. The circular duct 104 may be formed to have a fan shape in order to connect the duct plate 103 and the side duct 70. However, the circular duct is not limited thereto, and may have any shape as long as the circular duct may connect the duct plate 103 and the side duct 70.

The extension member 105 may connect each of the hanging frames 101 and 102 and the duct plate 103 so that the heated air may be supplied to the shoe. In this case, as illustrated in FIG. 3, the heated air may be introduced into the hanging frames 101 and 102 from the duct plate 103 through the inlet hole 106.

When the shoe hanging device 100 is removed, a cover (not shown) of the side duct 70 may block the side duct 70 by an elastic member (not shown) to prevent the heated air from leaking out. Conversely, when the shoe hanging device 50 is inserted, the duct plate 103 may operate to open the cover (not shown).

The duct plate 103 and the circular duct 104 may include the injection ports 103*a* and 104*a*, respectively. Each of the injection ports 103*a* and 104*a* may supply the heated air to a lower side of the duct plate 103 to take care of the shoes supported on the lower side. The present disclosure exemplifies that the duct plate 103 and the circular duct 104 are provided with two of the injection ports 103*a*, respectively, but is not limited thereto, and three or more of the injection ports may be provided respectively.

That is, the duct plate 103 allows the heated air to be supplied to the hanging frames 101 and 102 to take care of shoes with a long neck such as long boots, and allows the heated air to be supplied to the lower side through the injection port 103*a* to take care of the shoes arranged on the lower plate.

The drawings illustrate that the shoe support device is not mounted, but the shoe support device is not illustrated for convenience of description, and may be mounted on the shoe care apparatus. In such a case, shoes with a long neck and shoes with a short neck may be taken care of at the same time.

Figure 11:
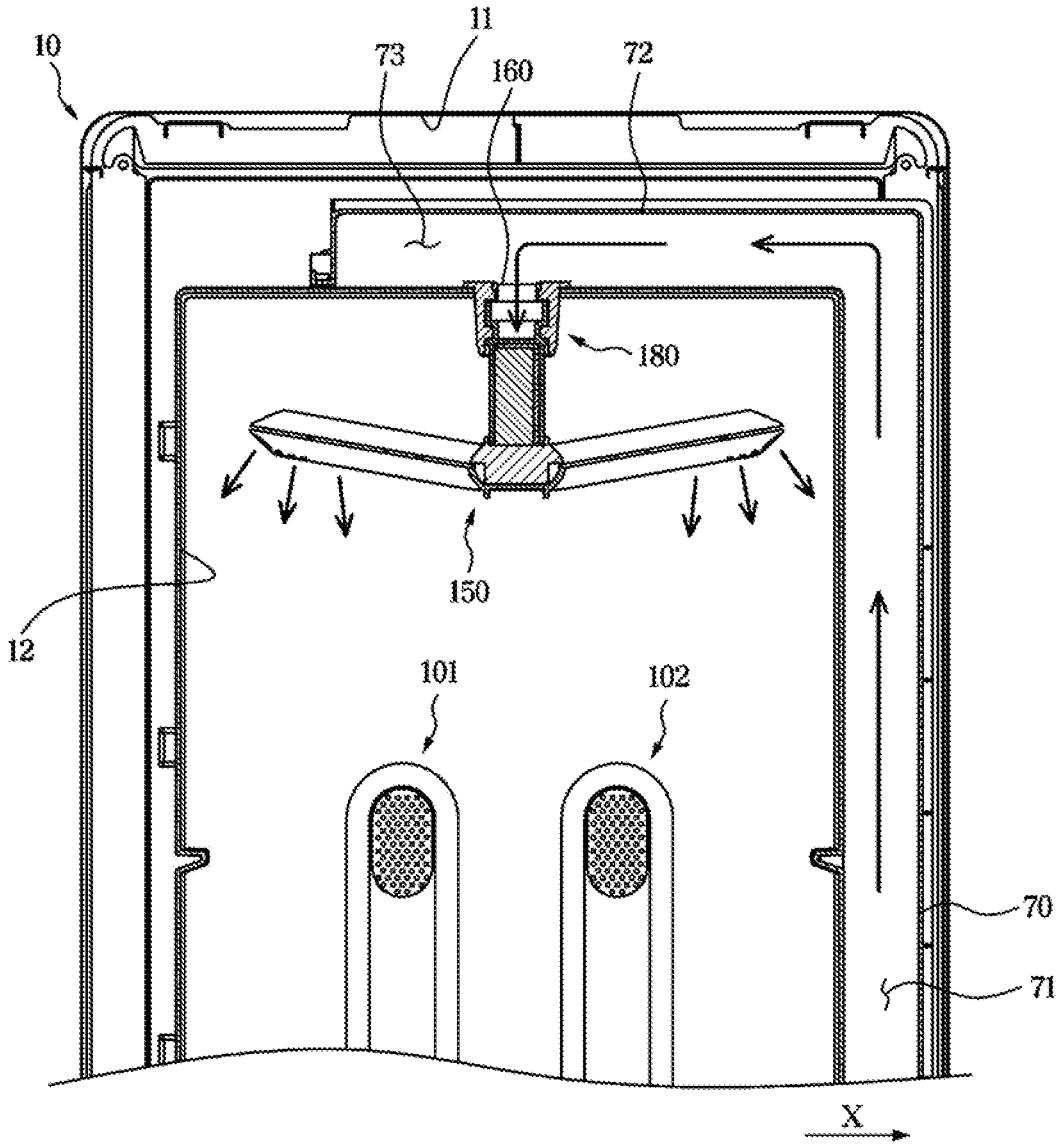
FIG. 11 is a cross-sectional view of an upper front surface of a shoe care apparatus according to another embodiment of the present disclosure.
Figure 12:
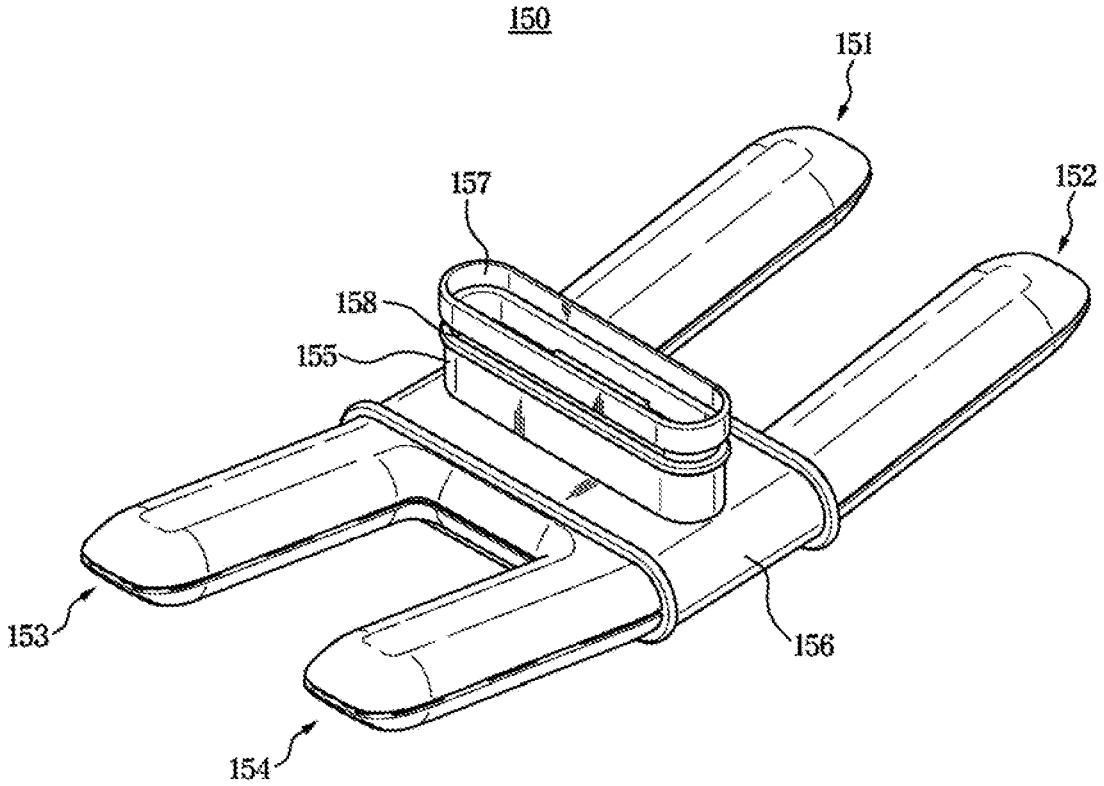
FIG. 12 is a perspective view illustrating a shoe support device of the shoe care apparatus illustrated in FIG. 11 according to an embodiment of the present disclosure.

FIG. 11 is a cross-sectional view of an upper front surface of a shoe care apparatus according to another embodiment of the present disclosure. FIG. 12 is a perspective view illustrating a shoe support device of the shoe care apparatus illustrated in FIG. 11.

Referring to FIGS. 11 and 12, the shoe care apparatus may further include an upper duct 72 and an upper flow path 73.

The upper duct 72 may be connected to the side duct 70. The upper duct 72 may be supplied with heated air and supply the heated air to a shoe support device 150. The heated air passed through the upper duct 72 may pass through the supply port 160. The heated air passed through the supply port 160 may be injected into the shoe care compartment 30 from the injection hole of the shoe support device 150. The upper flow path 73 may be formed in the upper duct 72.

Because the ducts for supplying heated air from the machine compartment 40 to the shoe care compartment 30 are formed on the upper and side surfaces, the length L2 of the side surface is not long, so that the shoe care apparatus may be installed even in a narrow hallway.

The shoe support device 150 may be installed on the mounting rail 180 to be detachably installed on the shoe care apparatus.

The shoe support device 150 may include support frames 151, 152, 153, and 154, a connection body 155, a support body 156, an inlet 157, and a fastening groove 158.

The support frames 151, 152, 153, and 154 may include the first support frame 151, the second support frame 152, the third support frame 153, and the fourth support frame 154. Accordingly, two or more pairs of shoes may be supported thereon. However, the present disclosure is not limited thereto, and less than four support frames, or four or more support frames may be provided in the shoe support device 150.

The support frames 151, 152, 153, and 154 may each include an injection hole. Although not illustrated in FIG. 12, as illustrated in FIG. 5, the injection hole may be formed on the lower surface or the side surface. In addition, the support frame may be provided at a predetermined angle with respect to the lower surface. That is, the support frame may be formed to be inclined upward. Accordingly, the shoes may be not taken off.

The support body 156 may be disposed between the support frames 151, 152, 153, and 154 to connect the respective support frames 151, 152, 153, and 154.

The connection body 155 may be provided on an upper side of the support body 156 and extend vertically. The connection body 155 may connect the support frames 151, 152, 153 and 154 and the supply port 160 to supply the heated air from the upper duct 72 to the shoe support device 150.

The first support frame 151 and the second support frame 152 may protrude in the first direction and may be disposed to be spaced apart from each other in the second direction. The third support frame 153 and the fourth support frame 154 may protrude in a direction opposite to the first direction and may be disposed to be spaced apart from each other in the second direction. Because the first support frame 51 and the second support frame 52 are provided to protrude in the first direction and be spaced apart from each other in the second direction, and the third support frame 53 and the fourth support frame 54 are provided to protrude in a direction opposite to the first direction and be spaced apart from each other in the second direction, the first to fourth support frames may support and care for the shoes, respectively.

The inlet 157 may be connected to the supply port 160 to introduce the heated air into the shoe support device 150.

The fastening groove 158 may be connected to the fixing member of the mounting rail 180 to prevent the shoe support device 150 from being separated from the shoe care apparatus.

Figure 13:
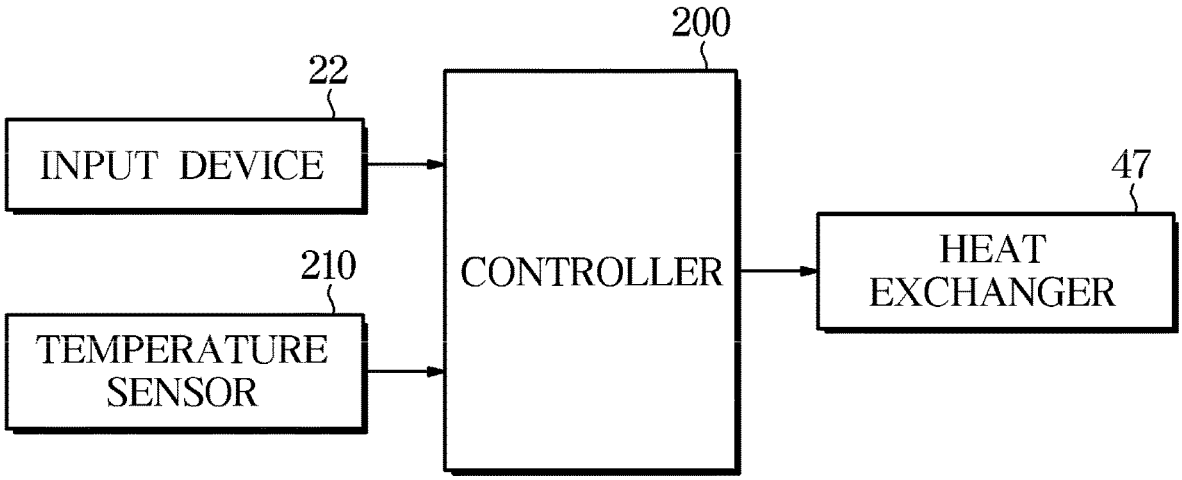
FIG. 13 is a block diagram illustrating a control flow according to an embodiment of the present disclosure.

FIG. 13 is a block diagram illustrating a control flow according to an embodiment of the present disclosure.

Referring to FIG. 13, the shoe care apparatus may further include a controller 200 and a temperature sensor 210.

When the user inputs a type of shoes or a desired control temperature through the input device 22, or the temperature sensor 210 detects a temperature outside a temperature outside 35 to 60 degrees, the controller 200 may control the heat exchanger 47 to regulate an inner temperature of the shoe care compartment 30. The controller 200 may receive information on the inner temperature from the input device 22 or the temperature sensor 210. However, the present disclosure is not limited thereto, and components such as the input device 22 and the temperature sensor 210 may be omitted.

An appropriate temperature in the shoe care compartment 30 may be regulated by the controller 200. That is, appropriate care may be performed depending on the material of the shoes.

The foregoing has illustrated and described specific embodiments. However, it should be understood by those of skilled in the art that the disclosure is not limited to the above-described embodiments, and various changes and modifications may be made without departing from the technical idea of the disclosure described in the following claims.

What is claimed is:

1. A shoe care apparatus comprising:

a case having a first surface having a first length extending along a first direction and a second surface having a second length extending along a second direction perpendicular to the first direction, the second length being shorter than the first length;

a shoe care compartment provided inside the case;

a supply port formed on a side wall of the case to supply heated air to the shoe care compartment;

a shoe support device provided to receive the heated air from the supply port and formed to be attachable to and detachable from an inner surface of the side wall of the case; and a side duct disposed outside of the side wall of the case along the first direction and connectable to the supply port so as to supply the heated air to the shoe care compartment, wherein the shoe support device is configured to allow shoes to be hanged and comprises a support frame formed to protrude along the first direction from a side surface of the shoe care compartment while the support frame is mounted on the shoe care compartment.

2. The shoe care apparatus according to claim 1, wherein the shoe support device is mounted on the shoe care compartment along the second direction.

3. The shoe care apparatus according to claim 2, wherein the support frame comprises an injection hole formed on at least one of a side surface and a lower surface of the support frame to supply the heated air to a shoe.

4. The shoe care apparatus according to claim 1, wherein the support frame is a first support frame, the shoe support device further comprises a second support frame, and the first support frame and the second support frame are formed to protrude from the side wall of the case along the first direction and are disposed to be spaced apart from each other along the second direction.

5. The shoe care apparatus according to claim 1, further comprising a mounting rail formed on the side wall of the case along the first direction so that the shoe support device is enabled to be fixed to the shoe care compartment.

6. The shoe care apparatus according to claim 5, wherein the mounting rail has one end closed to prevent the shoe support device from being separated, and another end open to allow the shoe support device to be inserted.

7. The shoe care apparatus according to claim 6, wherein the mounting rail is inclined along an upward direction from the one end toward the other end so that the shoe support device remains inserted into the mounting rail.

8. The shoe care apparatus according to claim 1, further comprising:

a duct plate connectable to the side duct to supply the heated air to the shoe care compartment.

9. The shoe care apparatus according to claim 8, further comprising:

a hanging frame connectable to the duct plate to receive the heated air and formed to extend to an upper side of the shoe care compartment to allow a shoe to be hanged, wherein the hanging frame comprises an injection hole formed on an outside of the hanging frame to supply the heated air to the shoe.

10. The shoe care apparatus according to claim 8, wherein the duct plate comprises an injection port formed on a lower surface of the duct plate to allow the heated air to be supplied downward from the duct plate.

11. The shoe care apparatus according to claim 1, further comprising a machine compartment provided at a lower portion of the case, the machine compartment is provided with a condenser, an evaporator, and a fan provided to blow the heated air passing through the condenser and the evaporator, and the condenser, the evaporator, and the fan are arranged along the first direction.

12. The shoe care apparatus according to claim 3, wherein the support frame is formed to be inclined upwards to maintain the shoe on the support frame.

13. The shoe care apparatus according to claim 4, wherein the shoe support device comprises a handle provided between the first support frame and the second support frame.

14. The shoe care apparatus according to claim 1, further comprising a controller provided to control a temperature in the shoe care compartment to thereby reduce damage to the shoes.

15. A shoe care apparatus comprising:

a case having a first surface having a first length extending along a first direction and a second surface having a second length extending along a second direction perpendicular to the first direction, the second length being shorter than the first length;

a shoe care compartment provided inside the case;

a machine compartment provided at a lower portion of the case and comprising a condenser, an evaporator, and a fan;

a supply port formed on a side wall of the case to supply heated air to the shoe care compartment;

a shoe support device provided to receive the heated air from the supply port and formed to be attachable to and detachable from the shoe care compartment; and a side duct disposed outside of the side wall of the case along the first direction and connectable to the supply port so as to supply the heated air to the shoe care compartment, wherein the condenser, the evaporator, and the fan are arranged along the first direction.

16. The shoe care apparatus according to claim 15, wherein the shoe support device is configured to allow shoes to be hanged and comprises a support frame formed to protrude along the first direction from the side wall of the case while the support frame is mounted on the shoe care compartment.

17. The shoe care apparatus according to claim 16, wherein the shoe support device is formed to be mounted on the shoe care compartment along the second direction.

18. A shoe care apparatus comprising:

a case having a first surface having a first length extending along a first direction and a second surface having a second length extending along a second direction perpendicular to the first direction, the second length being shorter than the first length;

a shoe care compartment provided inside the case;

a supply port formed on an upper wall of the case to supply heated air to the shoe care compartment;

a shoe support device provided to receive the heated air from the supply port and formed to be attachable to and detachable from an inner surface of the upper wall of the case; and a side duct disposed outside of the upper wall of the case along the first direction and connectable to the supply port so as to supply the heated air to the shoe care compartment.

19. The shoe care apparatus according to claim 18, wherein the shoe support device is configured to allow shoes to be hanged and comprises at least one support frame formed to protrude along the first direction while the at least one support frame is mounted on the shoe care compartment.

20. The shoe care apparatus according to claim 19, wherein the at least one support frame is a first support frame, and the shoe support device includes a second support frame, a third support frame, and a fourth support frame, the first support frame and the second support frame are formed to protrude along the first direction and are disposed to be spaced apart from each other along the second direction, and the third support frame and the fourth support frame are formed to protrude along a direction opposite to the first direction and are disposed to be spaced apart from each other along the second direction.

* * * * *